United States Patent [19]

Gaitan

[11] 4,400,830

[45] Aug. 30, 1983

[54] SHOWER CAP

[76] Inventor: Magdha Gaitan, 1450 S. Bayshore Dr., Apt. 914, Miami, Fla. 33131

[21] Appl. No.: 422,550

[22] Filed: Sep. 24, 1982

[51] Int. Cl.[3] ..... A42B 1/112

[52] U.S. Cl. ..... 2/68

[58] Field of Search ..... 2/68, 171, 175, 179, 2/198, 202

[56] References Cited

U.S. PATENT DOCUMENTS

| | | | |
|---|---|---|---|
| D. 182,632 | 4/1958 | Turner | D3/13 |
| D. 185,269 | 5/1959 | Emmet | D3/13 |
| 2,870,451 | 1/1959 | Brodsky | 2/202 |
| 3,009,159 | 11/1961 | Emmel | 2/68 |
| 3,019,444 | 2/1962 | Pollack et al. | 2/68 |
| 3,070,805 | 1/1963 | Bozocos | 2/68 |
| 3,234,563 | 2/1966 | Tabbat | 2/68 |
| 3,321,772 | 5/1967 | Arps et al. | 2/68 |
| 3,394,406 | 7/1968 | Bergens | 2/68 |
| 3,480,967 | 12/1969 | Hanford et al. | 2/68 |

*Primary Examiner*—Doris L. Troutman

*Attorney, Agent, or Firm*—Jesus Sanchelima

[57] ABSTRACT

A shower cap comprising a crown having a top section and a lateral section defining an opening that receives the wearer's head. The crown is reinforced with structural members that provide a shape to the crown intended to preserve the user's coiffure and at the same time it does not substract from its aesthetic appeal. A pair of strips are attached to the lower edge of the lateral section defining the opening and their terminations are free and detached from the lateral section so that, with the proper adhesive means, they may be used to snuggly fit the opening around the user's head.

4 Claims, 5 Drawing Figures

SHOWER CAP

BACKGROUND OF THE INVENTION

1. Field of the Invention

The present invention relates generally to bathing caps and more particularly to a novel and improved bathing cap which protects the user's coiffure from getting wet.

2. Description of the Prior Art

Several designs of shower caps have been used in the past with differing degrees of protection for the hair while compromising its aesthetic look and appeal. An example is described in U.S. Pat. No. 3,070,805 issued to Mary Bozocos on Jan. 1, 1963. The problem with this shower cap is that it does not protect the hairdo of the user since it does not have a structure separating the crowns from the hair.

Other patents disclosing shower caps and similar articles are U.S. Pat. Nos. 2,870,451; Des. 182,632; Des. 185,269; 3,009,159; 3,321,772; 3,394,406 and 3,480,967.

Other patents describing the closest subject matter provide for a number of more or less complicated features that fail to solve the problem in an efficient and economical way. None of these patents suggest the novel features of the present invention.

SUMMARY OF THE INVENTION

It is the main object of the present invention to provide a shower cap that will protect the user's coiffure from the water.

It is another object of this invention to provide a head cap with a pleasant and femenine appearance that is capable of covering the user's hair wave and rolls.

It is yet another object of the present invention to provide an all-weather rain hat that will preserve the user's hair wave.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
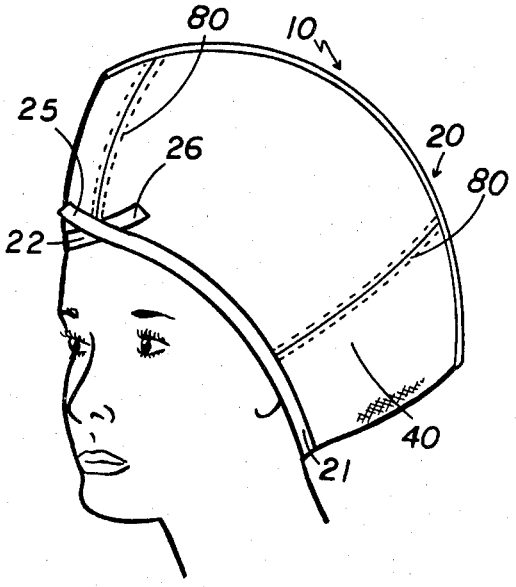
FIG. 1 illustrates the improved shower cap being worn by the user showing a partial front and side view.
Figure 2:
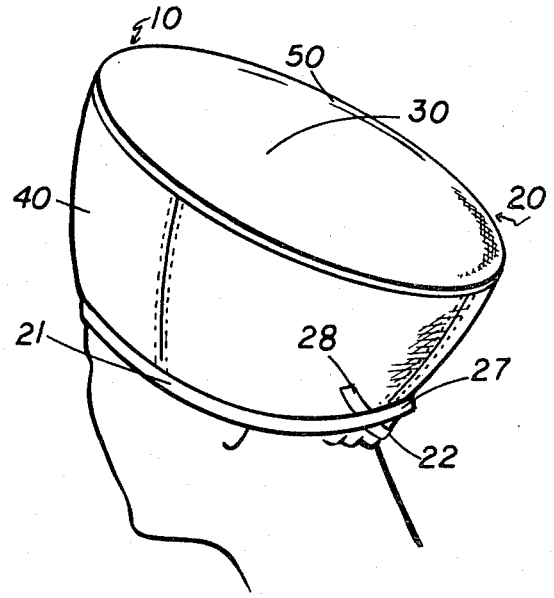
FIG. 2 represents the improved shower cap being worn by the user showing a partial rear and side view.

Referring now to FIGS. 1 and 2, where the improved shower cap has been referred to generally by numeral 10, it can be observed that the crown 20 has a round top 30 and a lateral band 40 attached to the lower periphery of top 30. A loop 50 is positioned on the interface between top 30 and band 40. Loop 50 is made out of a rigid material, a metallic wire in the preferred embodiment, and it is covered by an impervious sheet material making top 30 and band 40.

Figure 3:
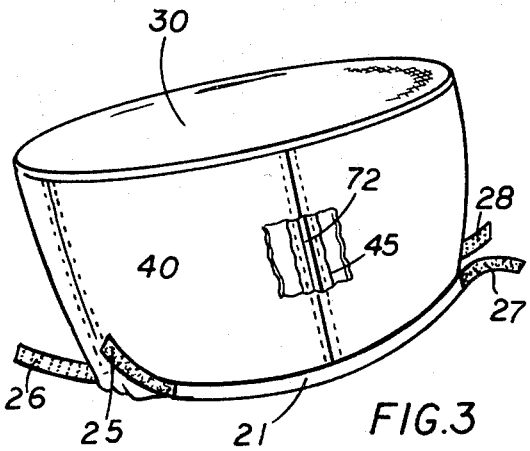
FIG. 3 represents the improved shower cap having a partial cross section illustrating one of the internal supporting members.
Figure 3A:
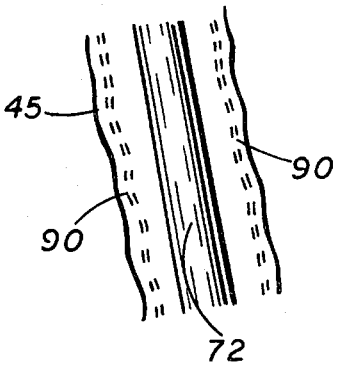
FIG. 3A represents a magnified view of the materials that constitute the crown of the improved cap.
Figure 4:
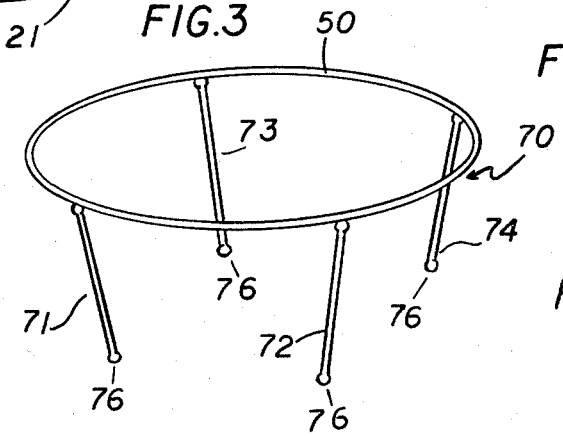
FIG. 4 illustrates the skeleton of the structural members that provide the shape of the improved shower cap.

FIG. 4 illustrates support structure 70 which comprises vertical support members 71; 72; 73 and 74, and loop 50. Loop 50 is not secured to any of the vertical support members directly, but it is kept adjoining these members by the proper stitching of the covering materials of crown 20. Vertical support members 71; 72; 73 and 74 are also kept in place by the proper stitching 90. FIGS. 3 and 3A illustrate a partial cross section of the lateral band 40 exposing one of the vertical support members and supporting strip 45 stitched on the inner wall of lateral band 40, thereby securing vertical support member 72 in place. Vertical support members 71; 72; 73 and 74 have a round termination 76 that prevents puncturing through the sheet material being used. The vertical support members are not attached or secured to loop 50, but rather just positioned perpendicularly to it through supporting strips 45. A pair of strips 21 and 22; as shown in FIGS. 1 and 2, are attached to the lower edge of lateral band 40. Strips 21 and 22 cover approximately one half of the lower periphery of lateral band 40 and have terminations 25 and 26 on the front and terminations 27 and 28 on the rear. In the preferred embodiment, terminations 25; 26; 27 and 28 have corresponding adhesive surfaces in the form of ELCRO strips. Of course, mating ELCRO surfaces need to be provided for the outer and inner surfaces of each termination pair, i.e., 25 with 26 and 27 with 28. Each pair of strips may be adjusted by the user and tightened by the lateral band 40 against the user's head to prevent any water from coming in.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. A shower cap, comprising:

A. a crown to completely cover the hair of the wearer's head having a top section defined by a rigid loop attached thereto and a lateral section attached to the periphery of said top section, the lower edge of said lateral section defining an opening that receives the wearer's head;

B. a pair of strips secured to the lower edge of said lateral section and having a termination on each end that is detached from said lateral section;

C. means for adhering said terminations to each other thereby providing a snug fit to the wearer's head;

D. a plurality of vertical support members extending downwardly and perpendicularly from said loop and being secured to the inner wall of said lateral section thereby providing structural integrity.

2. The shower cap set forth in claim 1 wherein said crown is made out of an impervious flexible material.

3. The shower cap set forth in claim 2 further comprising:

E. a plurality of stitched supporting strips sandwiching said vertical support members with the inner wall of said lateral section thereby securing said vertical support members in place.

4. The shower cap set forth in claim 3 wherein said vertical support members include a round termination on each one of its ends.

* * * * *